US005499564A

United States Patent [19]

Sanborn, III et al.

[11] Patent Number: 5,499,564

[45] Date of Patent: Mar. 19, 1996

[54] METHOD AND APPARATUS FOR FORMING A SPREAD

[75] Inventors: Charles H. Sanborn, III; Joel D. Clanton, both of Shelbyville, Tenn.

[73] Assignee: Ark, Inc., Shelbyville, Tenn.

[21] Appl. No.: 228,447

[22] Filed: Apr. 15, 1994

[51] Int. Cl.[6] ..... B65H 28/18; B65H 29/34

[52] U.S. Cl. ..... 83/23; 83/42; 83/87; 83/91; 83/94; 83/143; 83/155.1; 83/649; 83/936; 83/956; 270/30; 271/190; 271/217; 271/220; 271/308

[58] Field of Search ..... 83/23, 42, 86, 83/87, 91, 92, 94, 143, 155.1, 649, 936, 956; 226/170; 270/30; 271/182, 190, 198, 217, 220, 308

[56] References Cited

U.S. PATENT DOCUMENTS

| | | | |
|---|---|---|---|
| 586,073 | 7/1897 | Miehle | 271/190 |
| 2,065,301 | 12/1936 | Barber | 271/182 |
| 2,859,965 | 11/1958 | Pabst et al. | 271/190 |
| 3,034,632 | 5/1962 | Wampler | 198/402 |
| 3,198,513 | 8/1965 | Farez | 271/1 |
| 3,355,165 | 11/1967 | Southwell et al. | 271/12 |
| 3,370,849 | 2/1968 | Martin | 271/176 |
| 3,549,145 | 12/1970 | Troutmann | 271/184 |
| 3,603,587 | 9/1971 | Van Dorst | 271/65 |
| 3,618,546 | 11/1971 | Preston | 112/470.36 |
| 3,670,674 | 6/1972 | Conner, Jr. | 112/470.36 |
| 3,768,800 | 10/1973 | Gutknecht | 270/30 |
| 3,768,807 | 10/1973 | Spengler | 271/190 |
| 3,841,625 | 10/1974 | Carricato | 271/182 |
| 3,933,352 | 1/1976 | Sinn | 271/189 |
| 4,020,941 | 5/1977 | Kennedy | 198/402 |
| 4,027,580 | 6/1977 | Sundin | 414/790.7 |
| 4,157,823 | 6/1979 | Morton | 271/10.01 |
| 4,159,108 | 6/1979 | Haft | 271/190 |
| 4,175,655 | 11/1979 | Baldwin | 198/403 |
| 4,202,441 | 5/1980 | Bourgeois | 198/779 |
| 4,355,794 | 10/1982 | Costigan | 83/87 X |
| 4,395,037 | 7/1983 | Heine | 271/188 |
| 4,579,329 | 4/1986 | Frost et al. | 271/10.14 |
| 4,583,727 | 4/1986 | Fort | 271/19 |

(List continued on next page.)

FOREIGN PATENT DOCUMENTS

| | | |
|---|---|---|
| 203802 | 12/1986 | European Pat. Off. . |
| 706552 | 6/1931 | France . |
| 1948246 | 3/1971 | Germany . |
| 2538240 | 3/1977 | Germany . |
| 36247 | 2/1985 | Japan . |

OTHER PUBLICATIONS

Eastman Machine Company, Apparel Industry Magazine, Feb. 1991, p. 2.

Sunbrand, Niebuhr Spreading Machine, Synchron 125/250 TT Automatic Spreading Machine, p. 785, publication date unknown.

Eastman, Blue Streak II®/Model 629, p. 3, publication and publication date unknown.

*Primary Examiner*—Richard K. Seidel
*Assistant Examiner*—Raymond D. Woods
*Attorney, Agent, or Firm*—Senniger, Powers, Leavitt & Roedel

[57] ABSTRACT

An apparatus for forming a spread of generally thin, pliable material from a roll thereof onto a table includes a cradle for holding the roll of the material which is selectively operable to rotate the roll of material for feeding a web of material generally forwardly from the roll. An endless conveyor including a series of flights spaced at intervals therealong with openings between the flights is driven for forward travel, and the web from the roll of the material is received on and carried forward by a flight in the upper reach of the conveyor. A knife is operable to cut the web to separate a first sheet of material from the roll of material. The first sheet of material is thereafter held from forward movement with the supporting flight by grippers selectively operable for gripping the first sheet of material on the supporting flight in the upper reach of the conveyor. Thus, the supporting flight slides out from under the first sheet of material with the first sheet falling onto the table.

24 Claims, 12 Drawing Sheets

U.S. PATENT DOCUMENTS

| | | | |
|---|---|---|---|
| 4,645,193 | 2/1987 | Walton et al. | 271/18.3 |
| 4,647,265 | 3/1987 | Uno | 414/790.2 |
| 4,676,494 | 6/1987 | Smith et al. | 270/30 |
| 4,790,224 | 12/1988 | Krutilla et al. | 82/53 |
| 4,807,866 | 2/1989 | Stemmle | 271/209 |
| 4,881,479 | 11/1989 | Freermann | 112/475.04 |
| 5,040,778 | 8/1991 | Cole, Jr. | 271/65 |
| 5,082,267 | 1/1992 | Sanborn, III | 271/10.15 |
| 5,098,079 | 3/1992 | Sanborn, III | 271/176 |
| 5,167,406 | 12/1992 | Cole, Jr. | 271/6 |

METHOD AND APPARATUS FOR FORMING A SPREAD

The U.S. Government has a paid-up license in this invention and the right in limited circumstances to require the patent owner to license others on reasonable terms as provided by the terms of Contract No. DLA 900-87-C-0509 awarded by the Department of Defense.

BACKGROUND OF THE INVENTION

This invention relates to machinery for automated handling of thin, pliable material, such as fabric, and more particularly to apparatus which automatically forms a stack of sheets of the material from a long, continuous roll of the material.

The present invention has particular application in the mass production of wearing apparel. However, the principles of the present invention are generally applicable whenever handling of thin, pliable material is required, for instance, in the formation of pieces of a tent. In the apparel industry, fabric is received from the fabric manufacturer in the form of a roll and must be spread out for cutting into pieces which are later joined together to form the apparel. In common practice, the roll is spread out into a long stack consisting of layers of the fabric. The stack is cut to form the component pieces of the article of apparel to be produced. In this way, multiple pieces are formed with only a single cut.

Presently, the stack of material (referred to hereinafter as the "spread") is formed automatically by spread forming machinery including a gantry which is moved back and forth over the table on which the spread is formed. More specifically, the gantry includes a cradle in which the roll of fabric is held and which is operable to unroll the fabric for feeding a web of the fabric out of the gantry and onto the table as the gantry moves over the table. Fabric is frequently formed with an outer side having a design or finished appearance which will ultimately be on the outwardly facing side of the apparel. The inner side of the fabric has no design and/or is unfinished since it will not be seen when the apparel is worn. If a web of material is fed continuously out from the roll as the gantry moves both in a forward direction and a rearward direction over the table, the spread will be formed with adjacent layers of fabric facing different ways. In a so called "pair spread", one layer of fabric will have the outer side facing upward, and the adjacent layers will have their outer sides facing downward. One consequence of pair spreading is that when the spread is cut, pieces are formed which are mirror images of each other when turned so that both outer sides face the same way. Although both pieces are usable on the right and left sides of the article of apparel, it will be necessary to separate and divide out these pieces one from the other for later processing. Another consequence is that fewer pieces can be cut from the spread and more material will be wasted.

It is possible to form a "face up" or "face one way" spread in which all of the layers of fabric in the spread face the same way. However, to do this the gantry must be stopped at the end of its run in one direction (e.g., the forward direction) and the web of fabric fed out from the cradle cut away from the roll. The gantry must then travel in the rearward direction back to its start position with no fabric being fed out onto the table. Once the start position is reached, the gantry then travels forward again, feeding a web of material out onto the preceding web lying on the table as it goes. Thus, it may be seen that the formation of the face up spread takes at least twice as long as the formation of the pair spread because fabric is fed onto the table only when the gantry travels in one direction. The formation of the spread is a bottleneck in the manufacturing process. Thus, there is presently a need for spread forming methods and apparatus which permit rapid formation of face up spreads.

SUMMARY OF THE INVENTION

Among the several objects and features of the present invention may be noted the provision of a method for forming a spread of generally thin, pliable material to be cut and joined together into an article which is carried out rapidly so that the formation of the spread is not a bottleneck in the process for forming the article; the provision of such a method which produces a face up spread; the provision of such a method in which the roll of material remains adjacent one end of the table as the spread is formed; and the provision of such a method which is easy to use and may be economically carried out.

Further among the several objects and features of the present invention may be noted the provision of apparatus for forming a spread of the generally thin, pliable material which feeds the material rapidly from the roll without translational movement of the roll; the provision of such apparatus which forms a second layer of the spread at the same time the first layer is deposited on the table; the provision of such apparatus which is compact in design; the provision of such apparatus which rapidly severs the web from the roll.

Generally, a method for forming a spread of generally thin, pliable material from a roll thereof onto a table (the spread comprising a stack of sheets cut from said roll of material), includes the steps of:

(a) moving an endless conveyor having an upper reach disposed generally over the table so that the upper reach travels in the forward direction, the conveyor including a series of flights spaced at intervals therealong with openings between the flights;

(b) rotating the roll of material to feed a web of the material from the roll in a generally forward direction to the upper reach;

(c) carrying the web fed from the roll forwardly on a flight in the upper reach of the endless conveyor;

(d) stopping rotation of the roll of material and forward travel of the upper reach of the endless conveyor when a predetermined length of the web of material has been fed onto the flight;

(e) cutting the web of material to separate it from the roll of material thereby forming a first sheet of material supported on the flight in the upper reach of the endless conveyor;

(f) restarting rotation of the roll of material to feed another web of material from the roll generally in the forward direction to the upper reach;

(g) restarting movement of the upper reach of the endless conveyor in the forward direction;

(h) holding the first sheet of material on the flight in the upper reach of the endless conveyor from moving forwardly with the flight whereby the flight slides from underneath the first sheet and the first sheet falls through the opening trailing the flight and onto the table at the same time said other web of material is fed onto a trailing flight in the upper reach of the endless conveyor and is carried in the forward direction by the trailing flight; and (i) repeating steps (d)–(h) for said other web of material and subsequent webs of material fed from the roll thereby to successively cut sheets of material from said roll of material and stack them one on top of another on the table to a predetermined height to form the spread.

Generally, an apparatus for carrying out the foregoing method comprises means for holding the roll of material which is selectively operable to rotate the roll of material for feeding a web of material generally forwardly from the roll. An endless conveyor having upper and lower reaches also includes a series of flights spaced at intervals therealong with openings between the flights. The conveyor is driven for forward travel of its upper reach so that the web from the roll of the material is received on and carried forward by a flight in the upper reach of the conveyor. Means for cutting the web to separate a first sheet of material from the roll of material is located generally adjacent to a rear end of the upper reach of the conveyor. A table under the upper reach and between the upper and lower reaches of the conveyor holds the spread of material. The table is located in a fixed position relative to said roll holding means as the web of material is fed onto the conveyor. The first sheet of material is held from forward movement with the supporting flight by gripper means selectively operable for gripping the first sheet of material on the flight in the upper reach of the conveyor. Thus, the flight slides out from under the first sheet of material with the first sheet falling onto the table.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
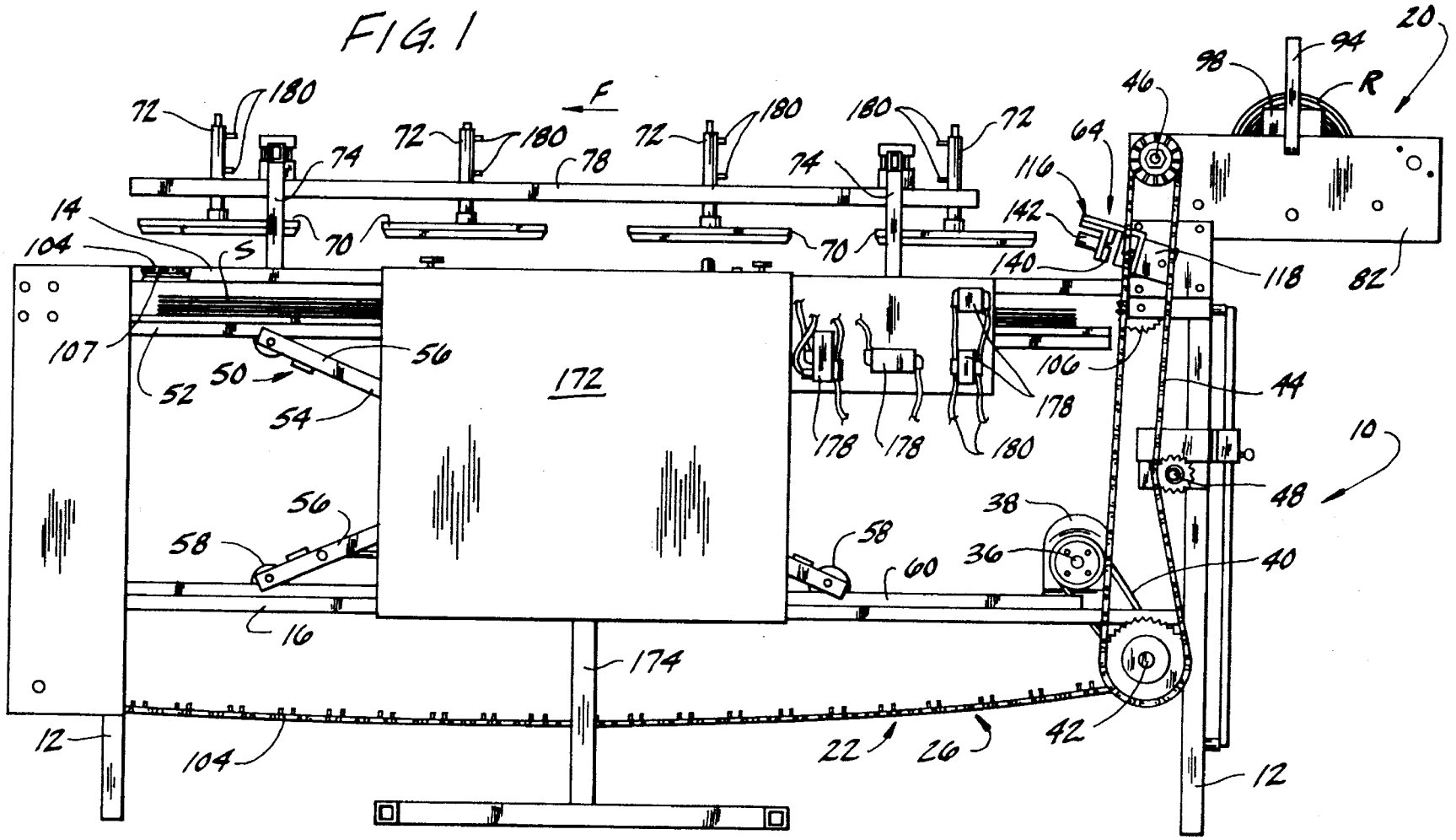
FIG. 1 is an elevation of the apparatus.

Referring now to the drawings and in particular to FIGS. 1, 2 and 3*a*–3*e*, apparatus for forming a spread S (constituting a stack of separate sheets of material from a continuous roll of the material) is shown to comprise a frame, indicated generally at 10, including four legs 12 (only two are shown), upper rails 14 and lower rails 16 extending longitudinally of the frame generally along its sides. The frame 10 mounts a cradle generally indicated at 20 for holding a roll R of generally thin, pliable material such as fabric. The cradle 20 is selectively operable to feed a web W (FIG. 3*a*) of material generally forwardly from the roll R and onto an endless conveyor (designated generally by reference numeral 22) having an upper reach and a lower reach (designated generally by reference numerals 24 and 26, respectively) and front and rear return reaches (not shown). The conveyor 22 is made up of at least two flights, a leading flight 28 and a trailing flight 30, spaced at intervals therealong with openings (e.g., trailing opening 32 and opening 34) between the flights. A drive wheel 36 of an electric motor 38 is connected by a chain 40 to a sprocket gear (not shown) of a drive shaft 42 for driving the conveyor 22 in the forward direction as indicted by arrow F in FIGS. 1 and 2. The drive shaft 42 is also connected via a second chain 44 to an input shaft 46 of the cradle 20 for actuating feeding of the web W of material from the roll R. The second chain 44 is also enmeshed with an idler gear 48 for maintaining tension on the second chain.

As described in detail hereinafter, the web W of material fed from the cradle 20 is received on and carried forward by the leading flight 28 in the upper reach 24 of the conveyor 20 over a table, indicated generally at 50, located between the upper and lower reaches 24, 26. The table 50 and the cradle 20 are mounted on the frame 10 and remain in fixed position relative to one another throughout the formation of the spread S on the table. As shown in FIG. 1, the table 50 includes a platform 52 mounted by a scissors support 54 including a pair of criss-crossing legs 56 pivotally mounted on the platform 52 at their upper ends and supported by rollers 58 on tracks 60 extending parallel to the lower rails 16 of the frame. There is another scissors support and track on the opposite side of the platform which is not shown, the construction of the other scissors support and track being identical to the scissors support 54 and track 60 shown in FIG. 1. The scissors support 54 permits the height of the platform 52 to be adjusted for accommodating spreads of different heights.

A clamping and cutting mechanism indicated generally at 64 incorporates the "cutting means" and "clamping means" set forth in the claims. The clamping and cutting mechanism 64 is operable to clamp and cut the web of fabric for separating a first sheet SH of the material (FIG. 3*b*) from the remainder of the roll R, with a trailing edge margin TE of the first sheet falling through the trailing opening 32 between the rear of the leading flight 28 and the front of the trailing flight 30 and onto a rear end of the platform 52. As shown in FIG. 4, the rear end of the platform 52 has strips 66 of high friction material such as foam rubber which grips the trailing edge margin TE of the first sheet SH to help hold the sheet from sliding across the platform.

Figure 2:
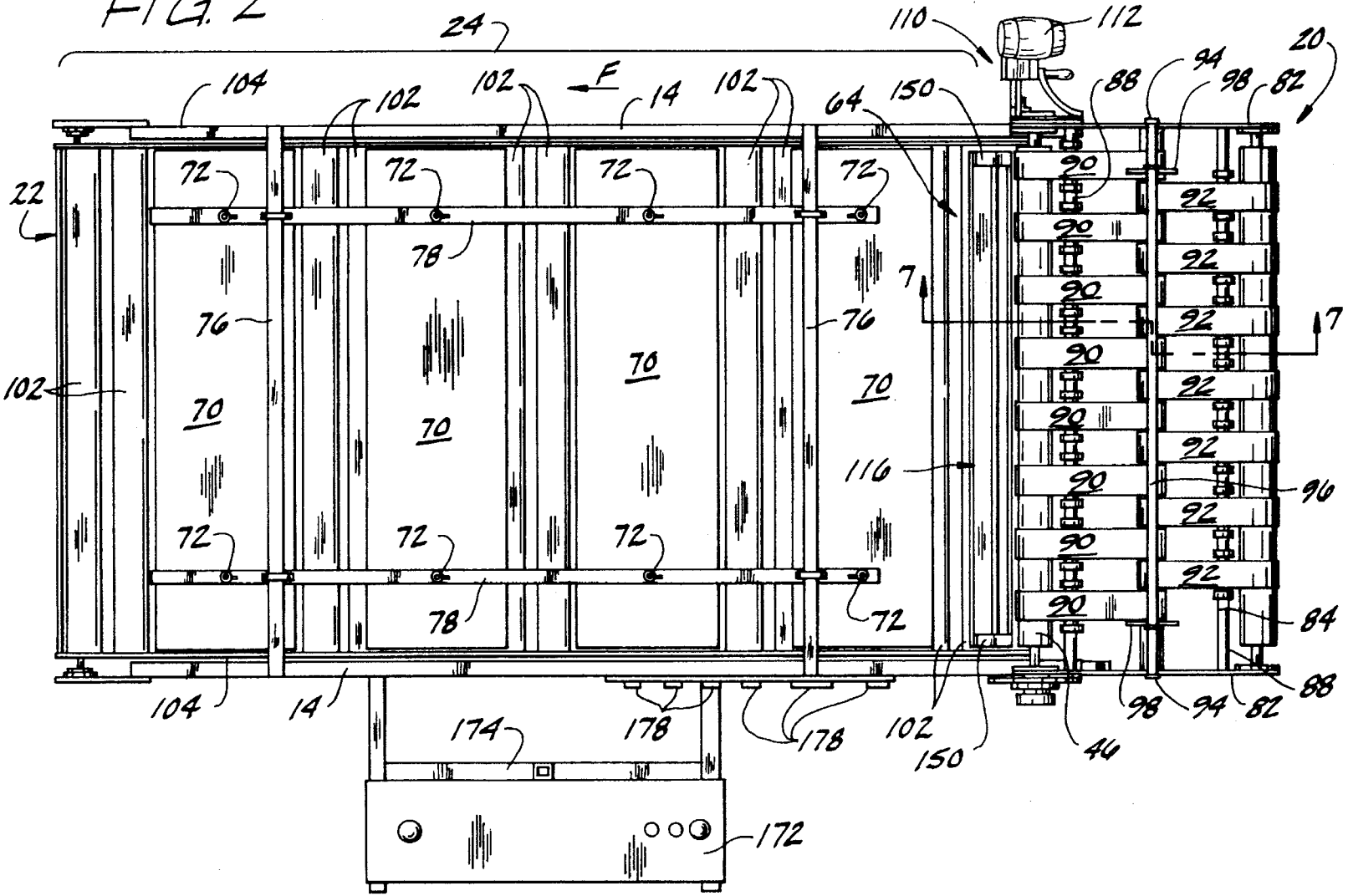
FIG. 2 is a top plan thereof.

Four wiper pads 70 are each mounted by two pneumatic cylinders 72 on a superstructure portion of the frame 10 above the upper reach 24 of the conveyor 22. Referring to FIGS. 1 and 2, the superstructure portion includes four columns 74 (only two are shown), with pairs of the columns being mounted on corresponding upper rails 14 of the frame on transversely opposite sides of the upper reach 24. Cross bars 76 extending between laterally opposing columns 74 mount longitudinal support members 78, on which the cylinders 72 are mounted. The cylinders 72 are selectively operable to lower the wiper pads 70 into engagement with the first sheet SH of material lying on the leading flight 28 in the upper reach 24 of the conveyor 22 for holding the first sheet from forward movement with the upper reach of the conveyor. In the first embodiment, the wiper pads have foam rubber or other frictionalizing material on their bottoms to facilitate gripping of the first sheet SH. Thus, when the wiper pads 70 engage the first sheet SH on the leading flight 28, the leading flight slides out from under the first sheet and the first sheet falls onto the platform 52 forming one of the layers of the spread (FIGS. 3*a*–3*e*).

Figure 7:
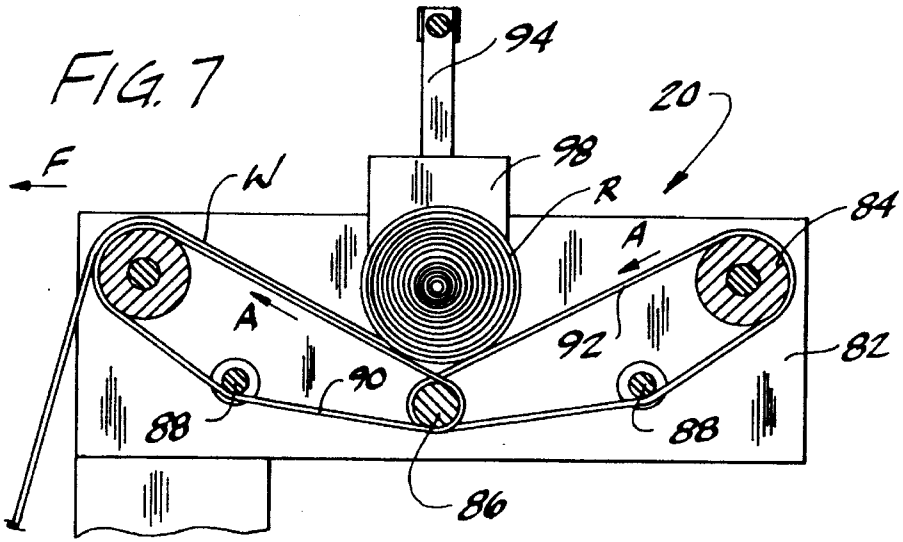
FIG. 7 is a fragmentary section taken in the plane including line 7—7 of FIG. 2.

As shown in FIGS. 2 and 7, the cradle 20, which is substantially the same as cradles presently used on spreading machines of the type which traverse the length of the table for forming the spread, includes end support plates 82 fixedly attached to the frame 10 adjacent a rear end of the table 50. The end plates rotatably mount the input shaft 46, a rear shaft 84, a center shaft 86 and a pair of idler shafts 88. A front set of endless belts, each designated by the reference numeral 90, extend between the input shaft 46 and the center shaft 86, and a rear set of endless belts, each designated by the reference numeral 92, extend between the rear shaft 84 and the center shaft. In this embodiment, the front belts 90 and rear belts 92 constitute the "moving floor" of the cradle 20 described in the claims. A roll restraining structure of the apparatus includes a pair of posts 94 mounted on the end plates 82, a rod 96 extending between the posts 94 and two laterally spaced paddles 98 engageable with the ends of the roll R of material to restrain it from substantial movement transverse of the forward direction F. Upon activation of the electric motor 38, the input shaft 46 is normally rotated in a counterclockwise direction (as viewed in FIG. 7). The counterclockwise rotation of the input shaft 46 is transmitted by the front belts 90 to the center shaft 86, and from there by the rear belts 92 to the rear shaft 84. The direction of movement of the upper reaches of the front and rear sets of endless belts 90, 92 is indicated by arrows A in FIG. 7. The indicated movement of the upper reaches of the belts 90, 92, through their engagement with the roll R of material, causes the roll to rotate in a clockwise direction for feeding the web W forwardly from the roll.

The web W of material extending forwardly from the roll R rests on the leading flight 28 in the upper reach 24 of the conveyor 22. As best illustrated in the schematic views of FIGS. 3*a*–3*e*, the leading and trailing flights 28, 30 of the conveyor 22 comprise a plurality of relatively closely spaced, channel-shaped slats 102 separated by the openings 32, 34 which are substantially wider than the spacing between slats making up a respective flight. In the preferred embodiment, the slats 102 are made of aluminum and have smooth upper surfaces for supporting the web W and first sheet SH. The slats 102 are connected at their ends to endless chains 104 (FIG. 2) engaged with sprocket gears 106 (FIG. 1, only one is shown) at the front and rear of the frame 10, and with the drive shaft 46 for movement in a closed loop. In the upper reach 24 of the conveyor 22, the chains 104 ride on rails 107 which support the slats 102 against deflection when loaded by the wiper pads 70. It is to be understood that the flights 28, 30 could be constructed otherwise than illustrated in the preferred embodiment and still fall within the scope of the present invention. For instance, the flights could each be formed of a continuous flexible sheet material. Moreover, the opening 32, 34 between adjacent flights could be no larger than the separation between adjacent slats 102 within a flight and still be within the scope of this invention, in which case the term "flight" would refer to the collection of slats which underlie and support the first sheet SH (or any subsequent sheet) of material.

The web W of material fed from the roll R passes through the cutting and clamping mechanism 64, as illustrated in FIGS. 3*a*–3*e*, before being received on the leading flight 28 in the upper reach 24 of the conveyor 22. Details of construction the cutting and clamping mechanism 64 are shown in FIGS. 5, 6, 8 and 9. A reciprocating electric knife, generally designated by reference numeral 110, has a motor 112 (FIG. 2) mounted on the apparatus frame 10 and a blade 114 extending from the motor transversely over the rear end of the upper reach 24 of the conveyor. The electric knife motor 112 is, in the illustrated embodiment, the same as the BLUE STREAK II® Model 629 fabric cutter manufactured by Eastman Machine Company of Buffalo, N.Y. However, the cutter has been modified by replacing the relatively short blade used for cutting through a few inches of fabric with the long blade 114 illustrated herein for cutting across the entire width of the web W of material. Moreover, the speed of the knife 110 is reduced by reduction gearing (not shown) from about 3600 strokes per minute to about 800 to 1000 strokes per minute.

Figure 5:
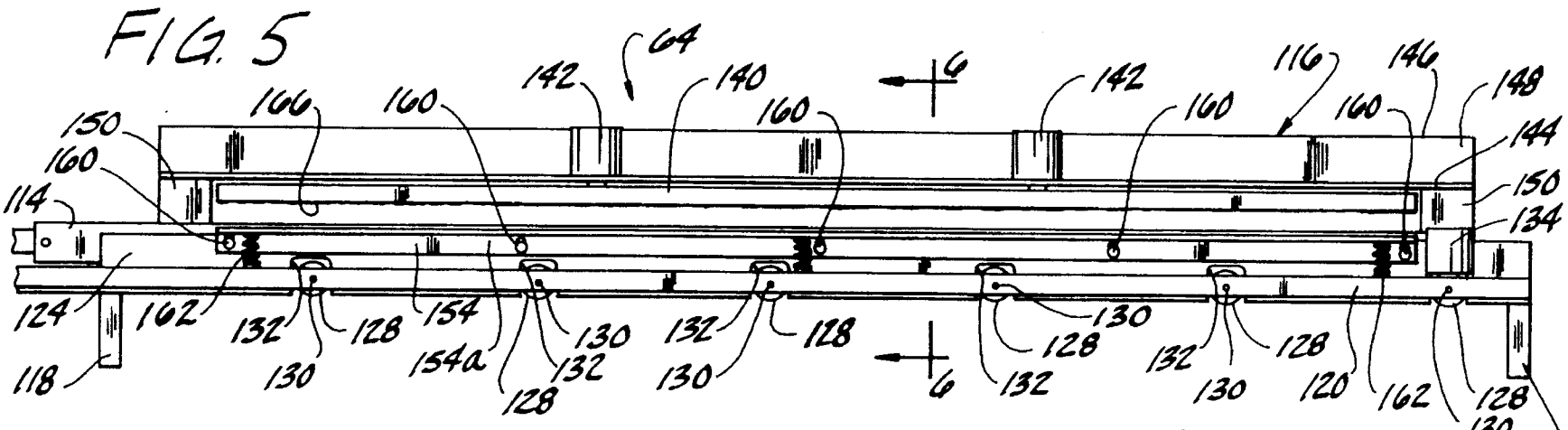
FIG. 5 is a fragmentary section taken in the plane including line 5—5 of FIG. 1, with portions of the apparatus other than its cutting and clamping mechanism removed.
Figure 6:
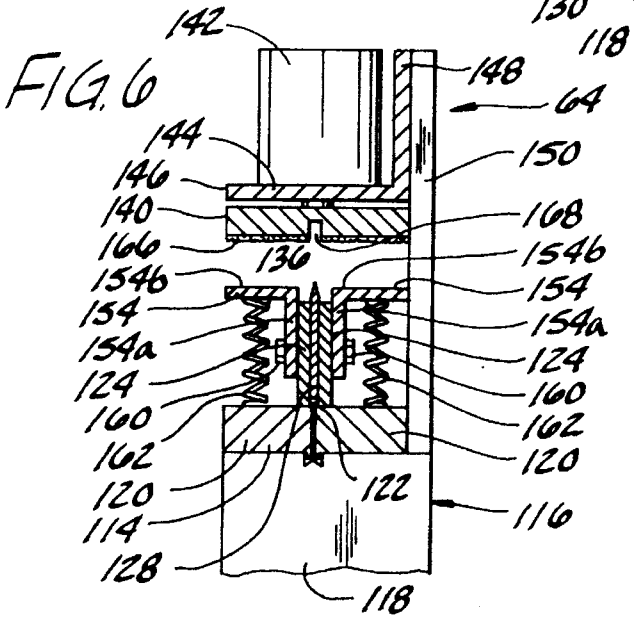
FIG. 6 is a section taken in the plane including line 6—6 of FIG. 5.
Figure 8:
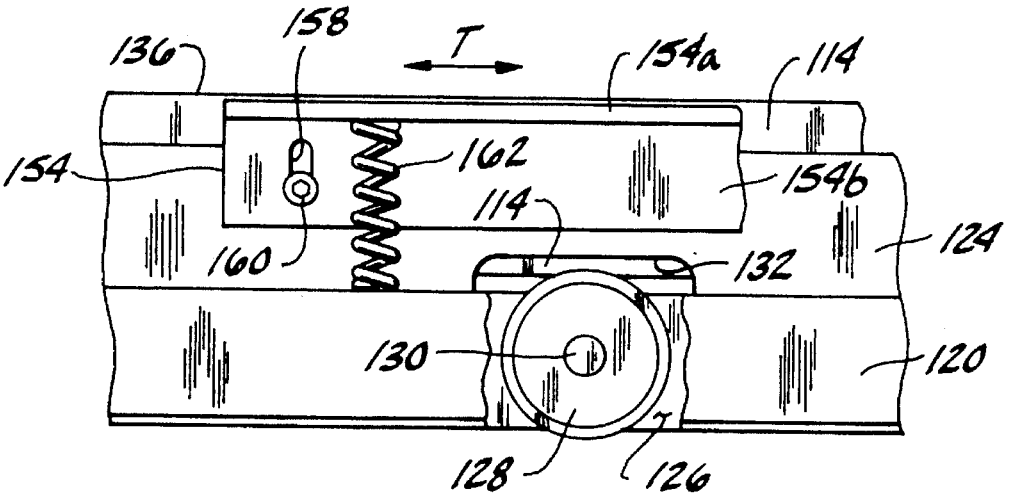
FIG. 8 is an enlarged fragmentary view of the clamping and cutting mechanism of FIG. 5, showing a blade mount and blade of the apparatus.
Figure 9:
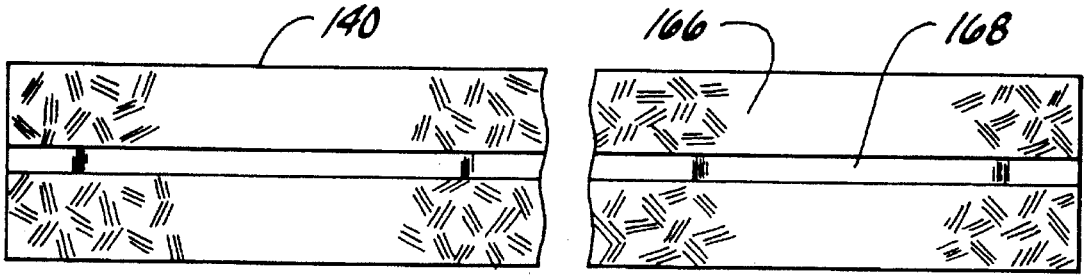
FIG. 9 is an enlarged, fragmentary view of a clamp platen of the cutting and clamping mechanism.

Referring now in particular to FIGS. 5, 6 and 8, the blade 114 is mounted by a frame, generally indicated at 116, including a pair of struts 118 mounted on the apparatus frame 10 and two elongate frame members 120 extending generally transversely of the upper reach 24 between the struts. The blade 114 is received in a channel 122 defined by a pair of elongate, thin guide bars 124, each mounted on a respective frame member 120 and extending transversely of the upper reach 24. The elongate frame members 120 have notches spaced along their lengths which are aligned to form a cavity 126 (FIG. 8) for receiving rollers 128, which constitute "support means" in this embodiment. However, other support means could be employed, such as the use of blocks (not shown) made of low friction material, and still fall within the scope of the present invention. Pins 130 which mount the rollers 128 for rotation on the frame members 120 also serve as the means by which the frame members are connected together. The guide bars 124 have notches 132 in registration with each other at spaced locations along their lengths permitting a portion of the rollers 128 to project outwardly from the cavities 126 defined by the frame members 120 and into the channel 122. The rollers 128 engage and support the blade 114 in the channel 122 while providing substantially no resistance to linear, reciprocating movement of the blade transversely of the upper reach 124 as indicated by double arrow T in FIG. 8. The distal end of the blade 114 is received in a semi-cylindrical block 134 mounted on the frame members 120 for shielding the end of the blade.

In order to cut the web W of material, it is clamped against a sharpened edge 136 of the blade 114 by a clamping mechanism including a clamp platen 140 and pneumatic cylinders 142 operable to selectively move the clamp platen between a release position in which it is spaced from the sharpened edge and the web is free to move between the sharpened edge and the clamp platen to the upper reach 24 of the conveyor, and a clamp position in which the clamp platen engages the web and forces it against the sharpened edge. The clamp platen 140 and air cylinders 142 are mounted on one leg 144 of a bracket 146 generally opposite the sharpened edge 136 of the blade. Another leg 148 of the bracket 146 is connected at its ends to respective spacer plates 150 mounted on one of the frame members 120 and extending forwardly away from the frame members and sharpened edge 136 of the blade.

Blade guards 154 protect the web W of material from inadvertent engagement with the sharpened edge 136 of the blade 114 as the web is fed onto the leading flight 28 in the upper reach 24 of the conveyor 22. In the illustrated embodiment, the blade guards 154 are inverted L-shaped bars each having a first leg 154*a* slidably mounted on a respective one of the blade guide bars 124, and a second leg 154*b* extending generally parallel to and opposing the clamp platen 140 (FIG. 6). The first leg 154*a* of each blade guard has elongated slots 158 at locations spaced along the length of the blade guard 154 through which are received fasteners 160 for connecting the first leg to the respective guide bar 124 while permitting the blade guard to slide in directions transverse to the lengthwise extension of the guide bars (FIG. 8). Three springs 162 bias the blade guards 154 toward an extended position as shown in FIG. 8, in which the second legs 154*b* of the blade guards lie substantially in a plane including the sharpened edge 136 of the blade 114 to protect the web W from engagement with the blade. The second legs 154*b* of the blade guards are engaged by the clamp platen 140 as it moves to its clamp position, and are retracted to expose the sharpened edge 136 of the blade for cutting the web W of material away from the roll to form the first sheet SH. The clamp platen 140 has a clamp face 166 made of frictionalizing material such as foam rubber for gripping the web W. A longitudinal clearance groove 168 in the clamp face 166 (FIG. 9) receives the sharpened edge 136 of the blade and provides clearance between the blade 114 and the clamp platen 140 so that the platen is not damaged as the blade cuts the web. The second legs 154*b* of the blade guards 154 provide reaction surfaces against which the web W is clamped by the clamp platen 140 to hold the material taut against the blade 114 to facilitate cutting. As the clamp platen 140 withdraws to its release position, the springs 160 move the blade guards 154 outwardly back into their position in which they protect the web from contact with the sharpened edge 136 of the blade.

Figure 10:
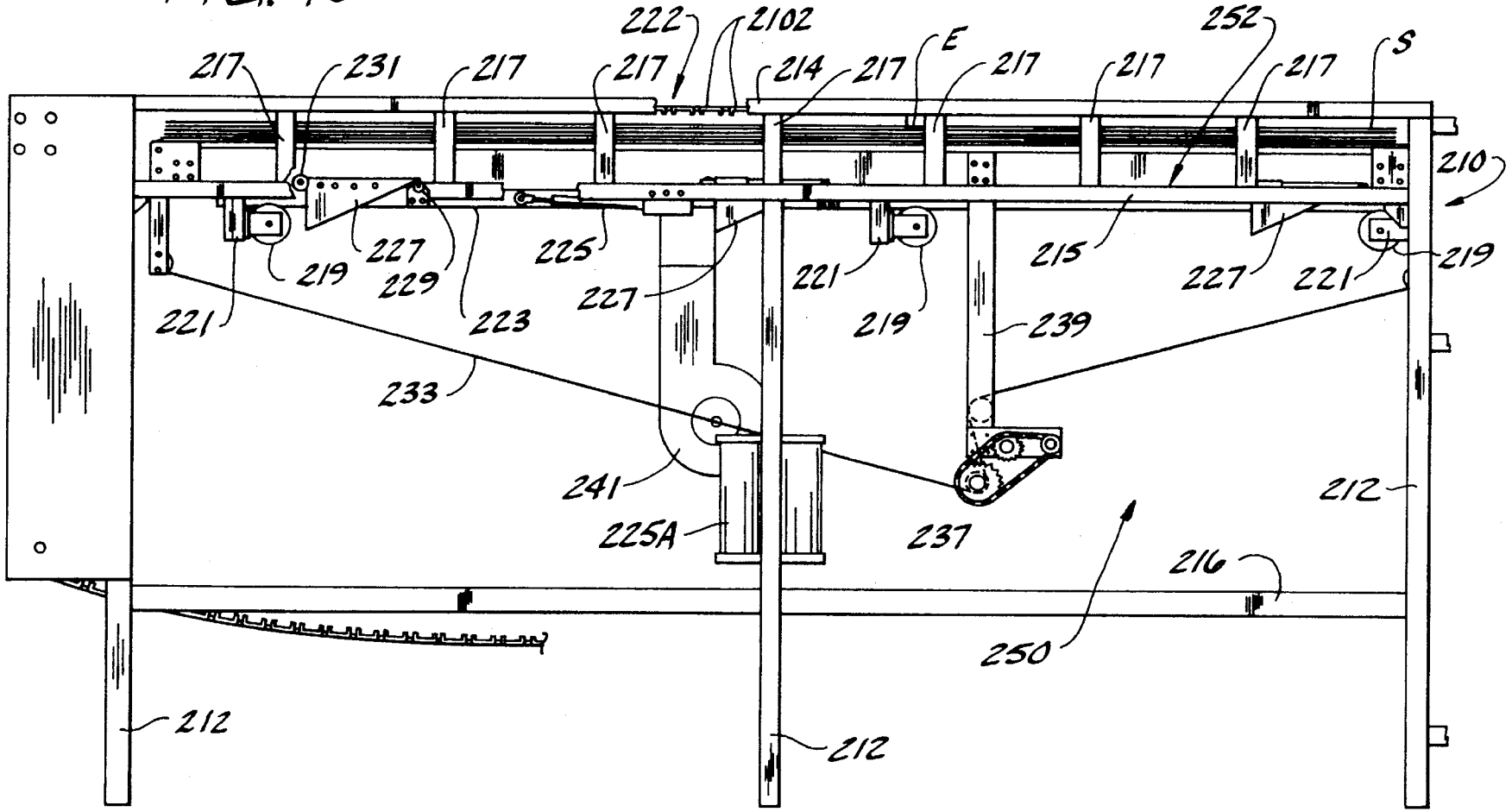
FIG. 10 is a fragmentary schematic view of a second embodiment of the apparatus showing an alternative construction of the table for holding the spread.
Figure 11:
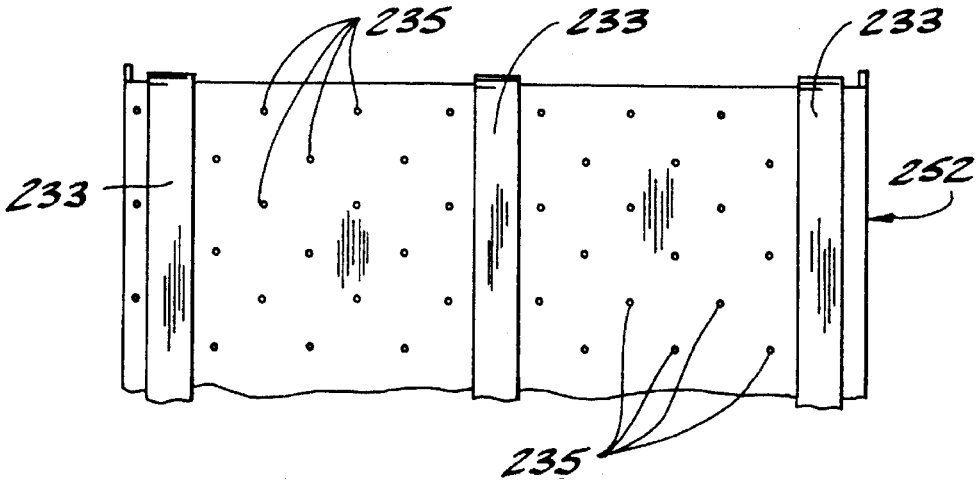
FIG. 11 is a fragmentary top plan view of the table of FIG. 10.
Figure 12:
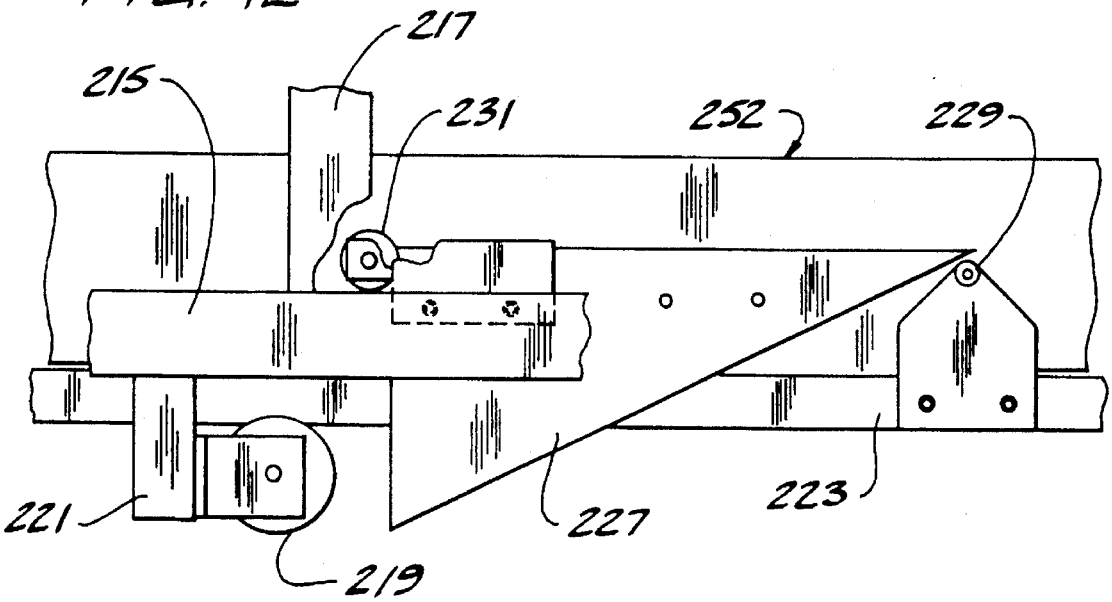
FIG. 12 is a greatly enlarged portion of the apparatus of FIG. 10 showing a mechanism used in raising and lowering the table.

Referring now to FIGS. 10–12, an apparatus of a second embodiment has a table for supporting the spread formed by the apparatus which is indicated generally by the reference numeral 250. The details of the apparatus, such as the cradle 20, conveyor 22 and wiper pads 70, which are identical in the second embodiment have not been illustrated in FIGS. 10–12 for simplicity. Corresponding parts of the apparatus shown in FIGS. 10–12 are indicated by the same reference number, with the addition of the prefix "2". The chain 104 and rail 107 supporting the chain in the upper reach 24 of the conveyor in the first embodiment have been removed in FIG. 10 to illustrate the shape and spacing of the conveyor slats 2102. The table 250 of the second embodiment differs from the table 50 of the first embodiment in that the scissors support 54 has been replaced with a different mechanism for raising and lowering the table, and by the provision of a mechanism for facilitating removal of a formed spread from the table.

The table 250 includes a box-like platform (indicated generally at 252) which is supported in a floating fashion on an intermediate rail 215 of the frame 210. The intermediate rail 215, which was not present in the apparatus of the first embodiment, is connected at its ends to the legs 212 of the frame 210 and also supported by struts 217 depending from the upper rail 214. Rollers 219 mounted by brackets 221 on the intermediate rail 215 support a moving frame 223 capable of moving lengthwise of the frame 210 on the rollers. A portion of the intermediate rail 223 has been broken away in FIG. 10 to show one of two pneumatic cylinders 225 (the other being located on the opposite side of the table 250) which is connected to the intermediate rail 215 and to the moving frame 223 for driving the motion of the moving frame relative to the intermediate rail. In order to generate sufficient force to lift the table 250, air over oil cylinders 225A are provided.

There are three longitudinally spaced bearing members 227 on each side of the table 250 for supporting the table. As shown in FIG. 12, the bearing members 227 have the shape of a right triangle and engage along the hypotenuse of the triangle rollers 229 mounted on the moving frame 215. A vertically extending side of each bearing member 227 engages a stop roller 231 mounted on the intermediate rail 215. The stop roller 231 prohibits motion of the bearing member 227 (and hence, table 250) to the left as shown in FIG. 12. The table 250 is shown in its lowest position in FIGS. 10 and 12. To raise the table 250, the cylinders 225 are activated to move the moving frame 223 to the left. The rollers 229 engaging the bearing members 227 push against the hypotenuse of the bearing members which converts the leftward directed force to a force having a vertical component. The rollers 231 engaging the vertical sides of the bearing members 227 prohibit leftward movement of the bearing members, but permit the bearing members to move vertically upward. The further the rollers 229 advance along the hypotenuse of the bearing members 227, the higher the level of the table 250 on the frame 210. To lower the table 250, the cylinders 225 are activated to move the moving frame 223 to the right. The weight of the table 250 forces it down as the rollers 229 move toward the right ends of the bearing members 227. The location of the rollers 229 along the hypotenuse of the bearing members 227 determines the height of the table.

As one alternative, the table 250 may be supported by hydraulic cylinders (not shown) which are mounted on the frame 210. The mounting of such cylinders is believed to be understood by those of ordinary skill in the art. The height of the table 250 underneath the conveyor 222 is controlled by an electric eye (not shown) positioned for observation of the top of the stack of sheets of material on the table. As more sheets are deposited on the table 250 and the height of the stack increases the eye is blocked, and sends a signal causing the table to be lowered. After the stack is removed from the table 250, the position of the table is automatically reset to a start position. In practice, maintenance of a spacing of approximately ½ inch between the bottom of the slats 230 of the conveyor 22 has produced satisfactory results.

The table 250 is constructed to facilitate removal of the spread formed by the apparatus. As shown in FIG. 11, there are three conveyor belts 233 extending longitudinally over the top surface of the platform 252. The conveyor belts 233 extend through a drive mechanism, generally indicated at 237, mounted on the platform 252 by a bracket 239 which selectively drives the motion of the conveyor belts. In addition, the platform 252 is constructed to enclose a plenum (not shown) for pressurized air. Holes 235 in the top surface of the platform 252 permit escape of air from the plenum to lift the spread from the upper surface and make it easier for the spread to be moved by the conveyor belts off of the platform 252 to a cutting table (not shown). Pressurized air is provided by a squirrel-cage fan 241 mounted on the bracket 237 for movement with the platform 252.

Referring now to FIGS. 13–16, an apparatus of a third and most preferred embodiment is shown. The parts of the apparatus of FIGS. 13–16 which are the same as the first embodiment are indicated by the same reference number, with the addition of a prefix "3". The parts of the apparatus of the third embodiment which are the same as the second embodiment are indicated by the same reference number, except that the prefix "2" is replaced by "3".

Figure 16:
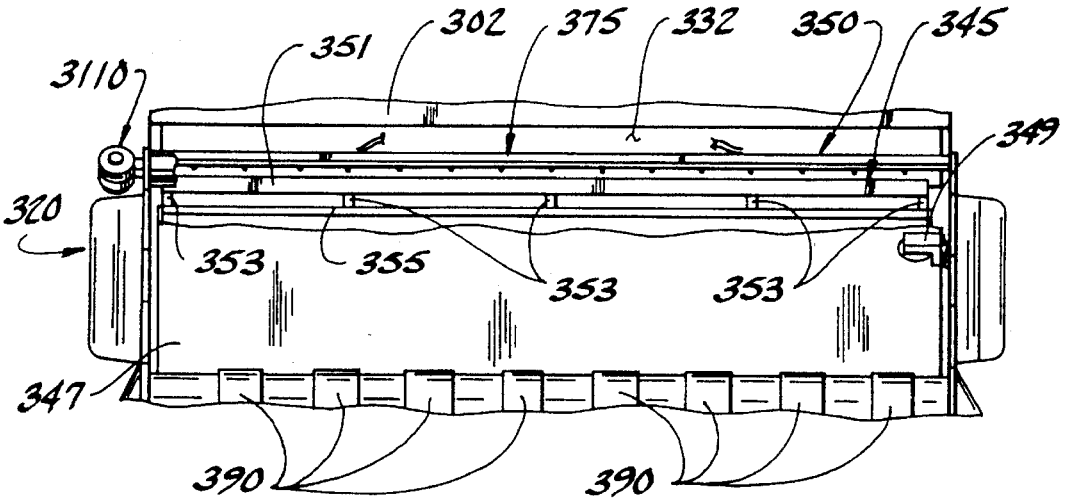
FIG. 16 is a fragmentary plan view of the apparatus of FIG. 13 with parts broken away to illustrate the location of the catcher mechanism.

The construction of the apparatus of the third embodiment is similar to that of the second embodiment. In particular, the table 350 is substantially identical in construction to the table 250, including specifically the mechanism for raising and lowering the table. The primary differences between the second and third embodiments are the provision in the third embodiment of a cradle (generally indicated at 343) for holding and dispensing craft paper, and a catcher mechanism (generally indicated at 345) for catching the trailing edge margin TE of sheet SH cut from the roll. The apparatus of the third embodiment further includes an additional section of the frame (designated generally by reference numeral 310') for mounting the cradle 320. The cradle 320 is taken from a commercially available spreading machines (i.e., the SYNCHRON 125/250 TT automated spreading machine manufactured by Niebuhr of Denmark and available in this country through their distributor Sunbrand of Atlanta, Ga.). The cutting and clamping mechanism 364 is oriented so that the web of material (not shown) turns through a smaller angle as it passes from the mechanism to the conveyor 322, and the squirrel cage fan 241 has been omitted. As shown in FIG. 16, the cradle 320 has a ramp 347 sloping down from the forward end of the forward belts 390 of the moving floor of the cradle toward the cutting and clamping mechanism 364. The ramp 347 is adapted to support the web of material extending from the moving floor of the cradle and has a gentle slope so that the web does not turn through large angles as it proceeds from the moving floor to the conveyor 322. A sensor 349 mounted adjacent the ramp 347 detects the location of a lateral edge of the web, and is operable to cause the cradle 322 to adjust the position of the roll to maintain the edge generally at a predetermined location. Maintenance of edge location facilitates the formation of a uniform spread which allows maximum usage of the cloth.

Figure 17:
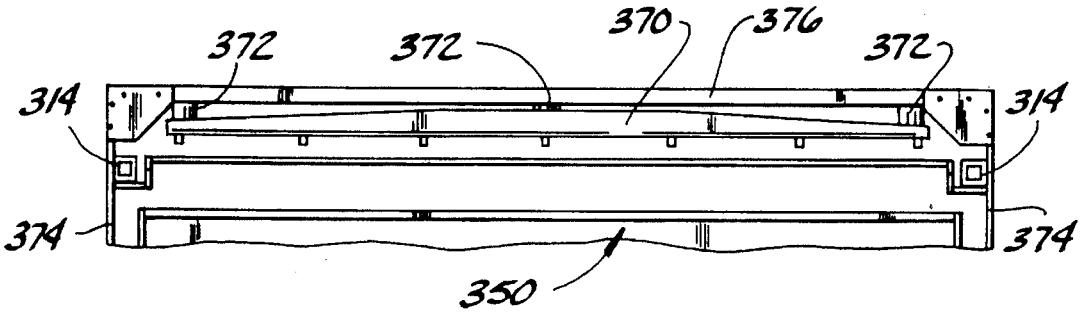
FIG. 17 is a fragmentary section taken in the plane of line 17—17 of FIG. 13 showing a wiper pad of the third embodiment.

As explained more fully below, the catcher mechanism 345 permits the use of fewer wiper pads 370 (FIG. 17), each having a smaller surface area for contacting the web of material on the conveyor 322 than in the apparatus of the second embodiment. Moreover, the wiper pads 370 are made entirely of aluminum and employ only small strips of foam rubber or other frictionalizing material to grip the material on the conveyor 322. In the third embodiment, the wiper pads 370 are mounted by the cylinders 372 on the cross bars 376. In some instances only one wiper pad 370 may be used. It is believed that the wiper pads 370 are not necessary for most fabrics because of the operation of the catcher mechanism 345.

Figure 13:
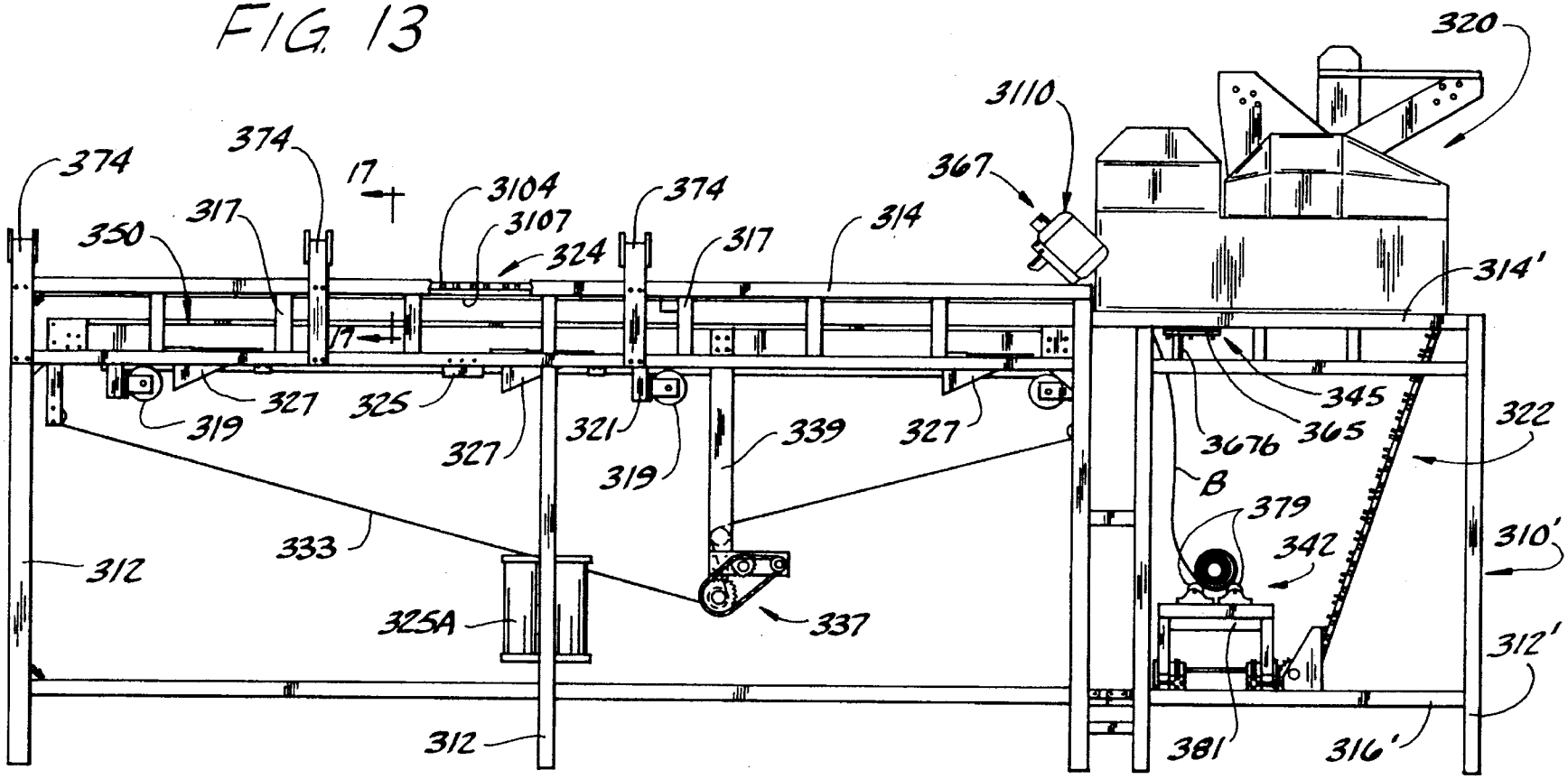
FIG. 13 is an elevation of an apparatus of a third embodiment.
Figure 14:
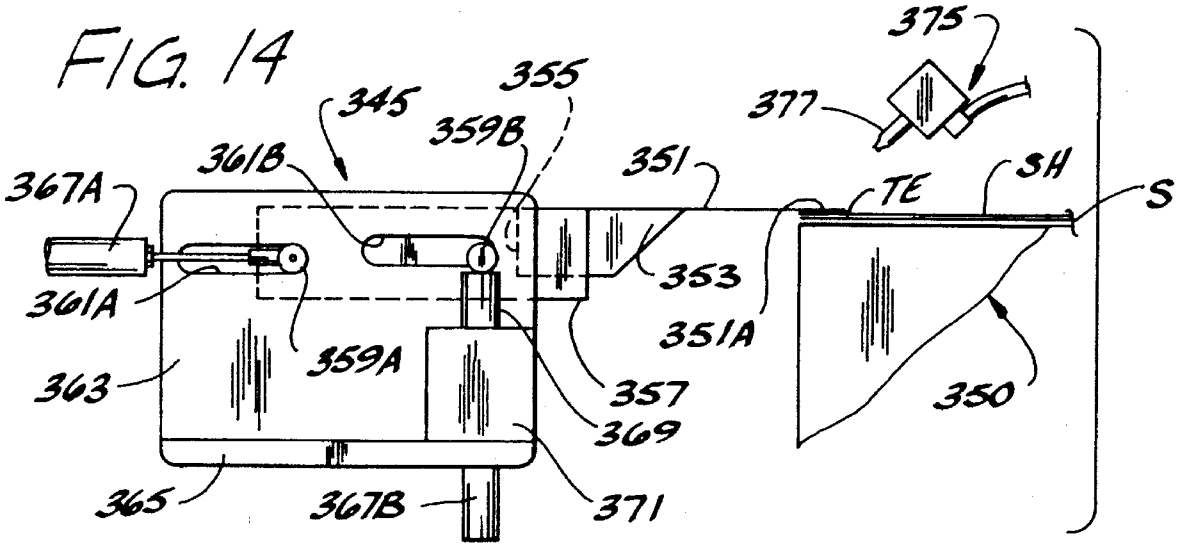
FIG. 14 is a schematic elevation of a catcher mechanism of the apparatus of FIG. 13 in its clamp position.
Figure 15:
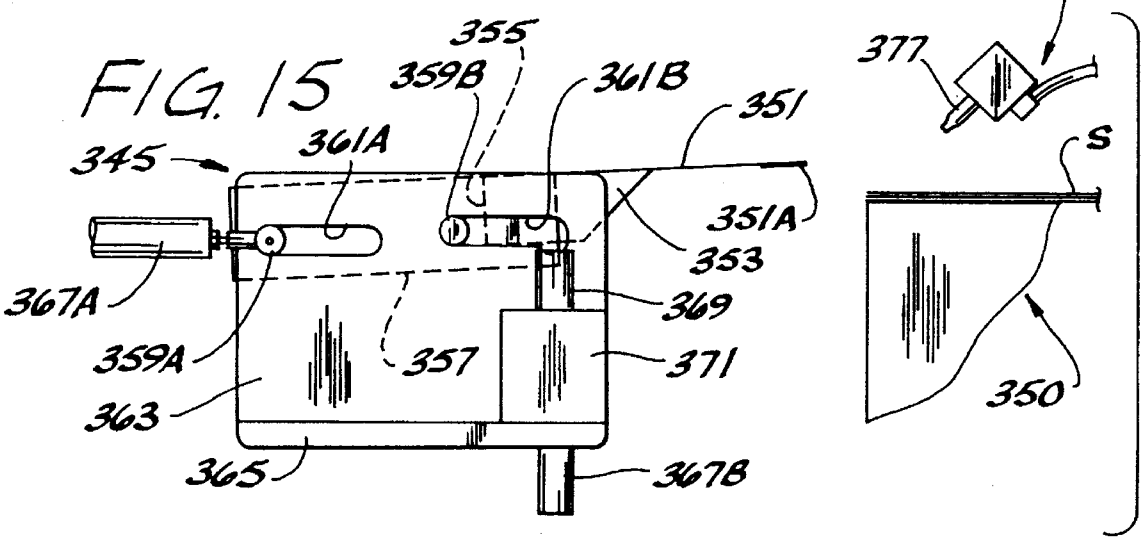
FIG. 15 is a schematic of the catcher mechanism in its release position.

Referring now particularly to FIGS. 14 and 15, the catcher mechanism 345 is operable to clamp the trailing edge margin TE of the first sheet SH of material after it falls through the trailing opening (not shown) of the leading flight of the conveyor 322 and onto the table 350. The catcher mechanism 345 includes an elongate, rectangular hold down bar 351 extending transversely across the end of the table 350 under the cradle 320 for substantially the full width of the table. The hold down bar 351 is mounted by a number of generally equally spaced connectors 353 on a square tube 355. Brackets 357 mounted on respective opposite ends of the square tube 355 each have two laterally outwardly projecting pins (designated 359A and 359B, respectively) received in slots (designated 361A and 361B, respectively) of a guide plate 363 mounted at a location spaced inwardly from the side of the additional section of the frame 310' by a mounting plate 365 connected to the upper rail 314' of the frame (FIG. 13). The longitudinal edge 351A of the bar is bent over on itself for additional strength.

A pair of pneumatic cylinders (designated 367A and 367B, respectively) on each end of the catcher mechanism 345 power its movement between a clamp position (FIG. 14) in which the trailing edge margin TE of the sheet SH of material cut away from the web is clamped by the hold down bar 351 against the table 350, and a release position in which the hold down bar is spaced above and to the rear of the end of the table. A first of the cylinders 367A is pivotally connected to the rearward pin 359A of the bracket 357 for sliding the pin generally horizontally in the rearward slot 361A. A piston rod (not shown) of a second of the cylinders 367B engages a pusher rod 369 slidably received in a block 371 mounted on the guide plate 363. The first cylinder 367A is operable to move the catcher mechanism 345 forward and backward. The forward slot 361B in the guide plate 363 has a downwardly extending recess 373 at its forward end, such that when the pin 359B riding in that slot reaches the forward end of the slot the pin drops down into the recess causing the hold down bar 351 to move down against the trailing edge margin TE of the sheet SH. The second cylinder 367B is operable to move the pusher rod 371 up out of the recess 373 to permit the catcher mechanism 345 to be moved rearward by action of the first cylinder 367A.

A manifold, indicated generally at 375, mounted on the underside of the cutting and clamping mechanism 364 has a plurality of nozzles 377 projecting generally rearwardly and downwardly from the manifold. Air is directed from the nozzles 377 against the trailing edge margin TE of the sheet SH as it drops to the table 350 to push the trailing edge margin toward the rear end of the table and under the hold down bar 351. Thus, the stream of air from the nozzles 377 helps to place the trailing edge margin TE in the proper location for clamping by the hold down bar 351. In operation, the stream of air is activated as the conveyor 322 is slowed in preparation for stopping. As soon as the conveyor 322 is stopped, movement of the catcher mechanism 345 from the clamp position to the release position is initiated. Approximately 0.5 seconds after the electric knife 3110 is deactivated, the catcher mechanism 345 is moved back to the clamp position and the conveyor 322 is restarted. Because of the greater inertia of the conveyor 322, the catcher mechanism 345 is able to reach the clamp position prior to actual movement of the conveyor, even though commands to restart the motion of the clamp mechanism and conveyor are given simultaneously. It is envisioned that rather than the use of a timer delay to assure that the trailing edge margin TE is in the proper location for clamping, sensors (not shown) could be used to detect the presence of the trailing edge margin. The catching mechanism 345 would be activated upon detection of the trailing edge margin TE in the proper location for clamping.

Craft paper is placed on the table 350 under the spread to facilitate handling and to keep the fabric in the spread clean.

In the third embodiment, the craft paper cradle 343 mounted on the frame 310' includes two rollers 379 for holding a roll of craft paper C (FIG. 13). The rollers 379 are mounted for rotation on a platform 381 supported by the frame 310'. The platform 381 may be moved laterally out from under the frame 310' for replacing the roll of craft paper C.

A web of craft paper B fed up from the roll C and onto the table 350 shields the bottom sheet of material in the spread from dirt, grease and the like. Moreover, the craft paper facilitates removal of the spread from the table 350 after it is formed. The forward free edge of the craft paper (not shown) can be grasped and pulled to slide the spread out from under the upper reach 324 of the conveyor 322 for further processing. At the same time, new craft paper is pulled off the roll C and onto the table 350. The craft paper is cut to the rear of the spread after the spread is pulled out from under the upper reach 324 of the conveyor to separate the spread from the web B of craft paper extending from the roll C.

Having described the construction of the preferred embodiments of the apparatus, its general operation will now be described, with particular reference being made to FIGS. 3*a*–3*e*. The roll R of material out of which the spread S is to be formed is placed in the cradle 20 between the paddles 98 of the roll restraining structure. It is envisioned that the placement of the roll R in the cradle 20 could be substantially or entirely automated using commercially available carousels (not shown) capable of holding multiple rolls and selectively bringing the rolls in position to be loaded into the cradle. The electric motor 38 operable to drive the front and rear sets of belts 90, 92 in the cradle 20 for feeding the web W outwardly from the roll as shown in FIG. 7 is controlled by a controller 172. The controller 172 is mounted on a support 174 adjacent to the apparatus frame 10. The controller 172 has not been shown in the drawings second and third embodiments. The input shaft 46 of the cradle 20 and the conveyor chain 104 are both connected to the drive shaft 42 so that operation of the cradle to feed the web W of material and movement of the conveyor 22 occur simultaneously.

Activation of the electric motor 38 by the controller 172 causes the web W of material to move forwardly from the roll R, down through the cutting and clamping mechanism 64 and onto the leading flight 28 in the upper reach 24 of the conveyor 22. The web W is carried forwardly both by continued feeding from the cradle 20 and the forward motion of the leading flight 28. An electric eye (not shown) detects the trailing opening 32 between the leading flight 28 on which the web W is being laid, and the trailing flight 30, causing the controller 172 to slow down the electric motor 38. Another electric eye (not shown) signals the controller 172 to stop the motor 38 when the trailing opening 32 is disposed over the rear end of the table platform 52 and the strips 66 of high friction material thereon. Stoppage of the conveyor 22 and cradle 20 occurs when a predetermined length of the material has been fed onto the leading flight 28. It is envisioned, as an alternative to the use of electric eyes to signal various operations, that a shaft encoder (not shown) could be used so that the position of the conveyor 22 is precisely known at all times by the controller 172.

Figure 3A:
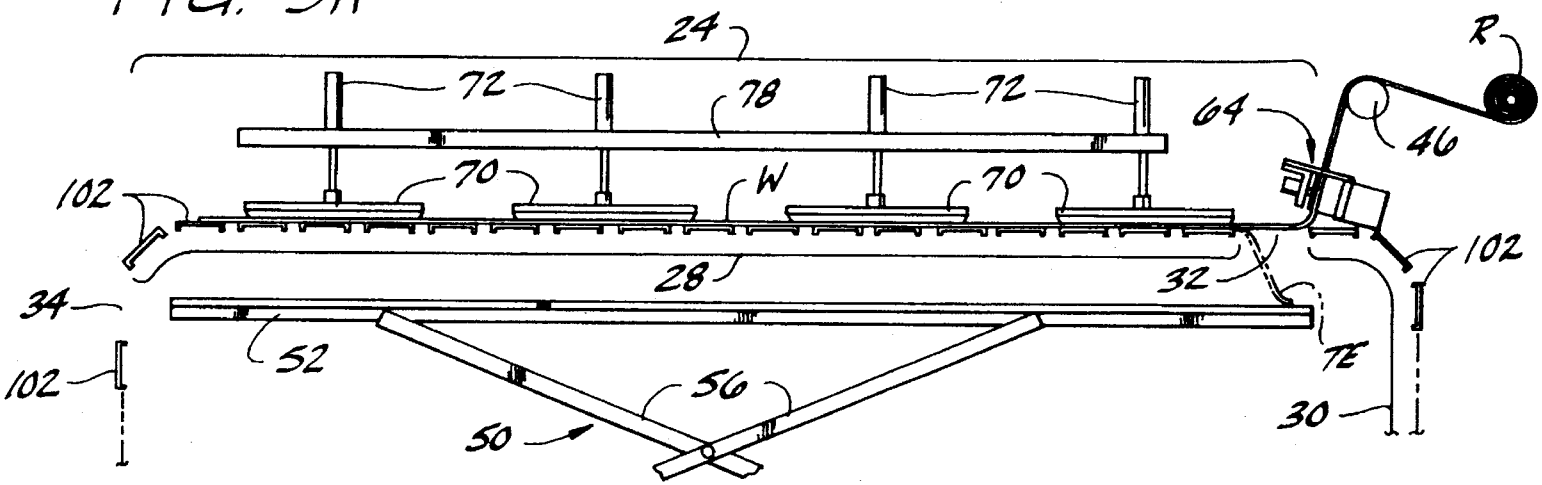
FIGS. 3*a*–3*e* are schematics of the apparatus illustrating its operation.

The controller 172 operates solenoid valves 178 (FIG. 1, only two are shown) to cause the cylinders 72 (connected by lines 180 to the solenoid valves) to lower the wiper pads 70 into engagement with the upper surface of the web W lying on the leading flight 28 in the upper reach 24, and to activate the cylinders 142 move the clamp platen 140 into its clamp position with a transverse region of the web W held taut against the sharpened edge 136 of the exposed blade 114. The apparatus is illustrated in FIG. 3*a* in this position. The lines 180 connecting the solenoid valves 178 and cylinders 72, 142 have been broken away in FIG. 1 and completely removed from the other drawings for clarity, the connection of the lines being readily understood by one of ordinary skill in the art. The knife motor 112 is energized for reciprocating the blade 114 to cut the web W away from the roll to form the first sheet SH of material. It is believed that the clamping and cutting can be carried out in less than one second. The controller 172 operates the solenoid valves 182 to move the clamp platen 140 to the release position with the trailing edge margin TE of the first sheet SH falling through the trailing opening 32 and onto the strips 66 of high friction material on the table platform 52 (shown in phantom in FIG. 3*a*). As stated above, in the third embodiment the catching mechanism 345 activated to capture a portion of the trailing edge margin TE. It is to be understood that other types of cutting mechanisms may be used and fall within the scope of the present invention. For instance, a band saw (not shown) could be used in place of the reciprocating electric knife 110. However, a band saw is a lesser preferred embodiment because the relatively large wheels would be required on both sides of the table to turn the blade which would undesirably increase the footprint of the apparatus on the factory floor.

Figure 3B:
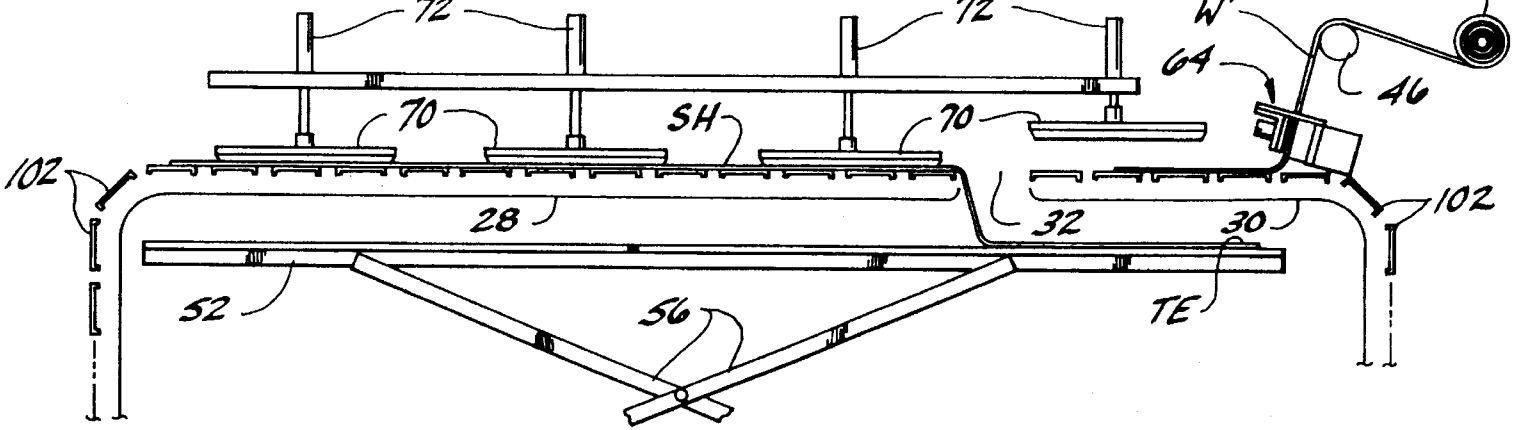
Figure 3C:
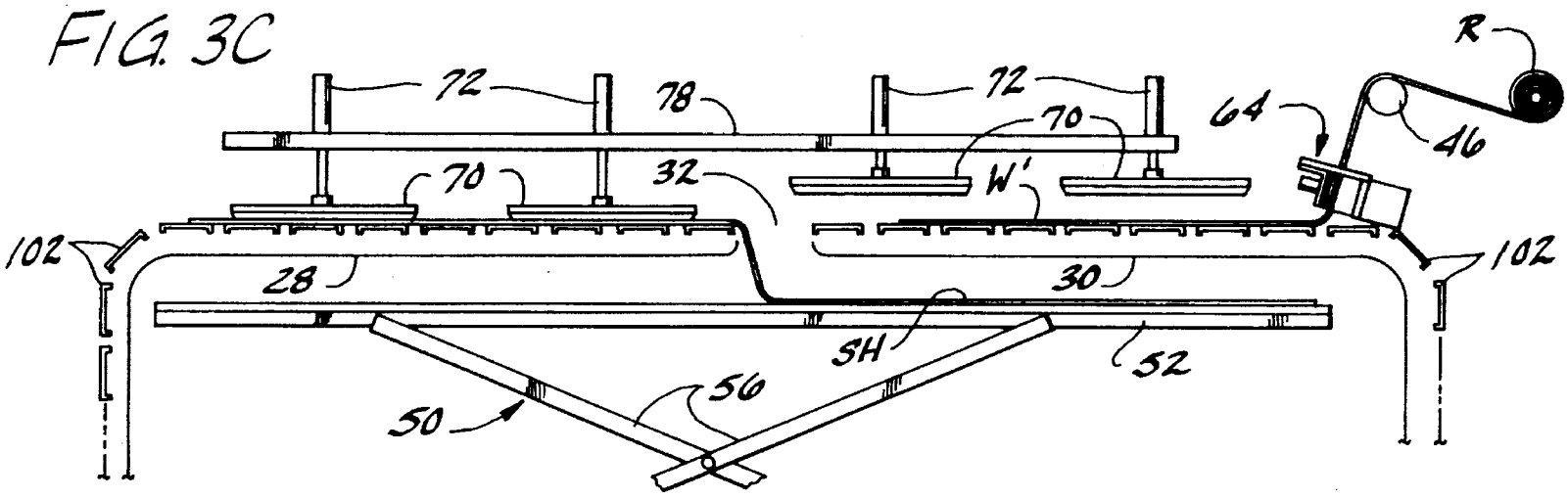
Figure 3D:
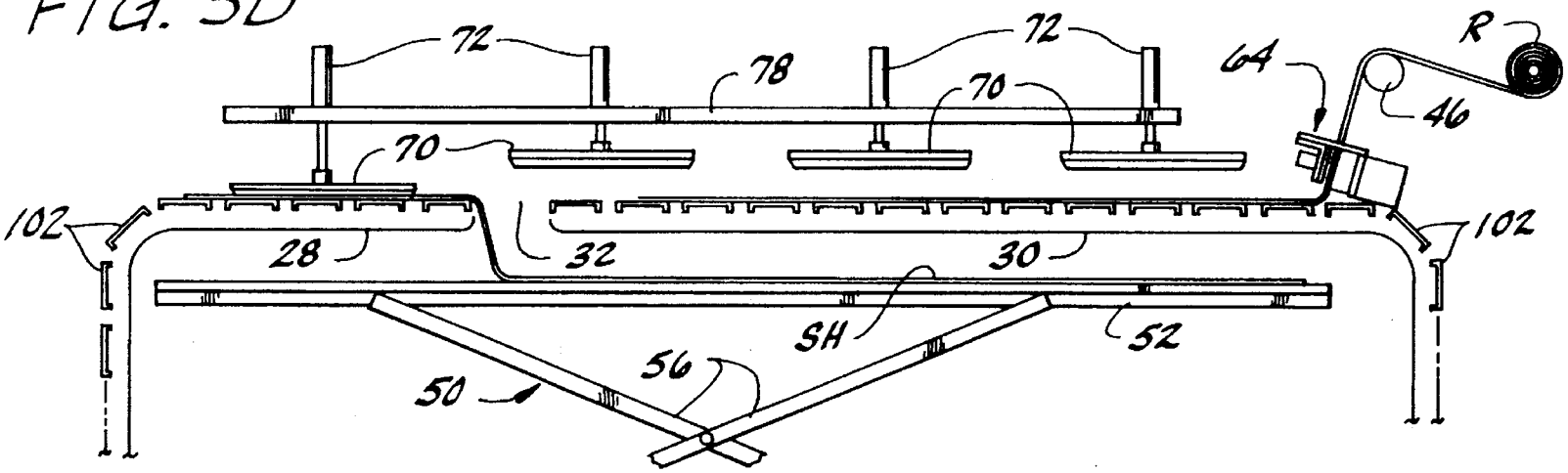
Figure 3E:
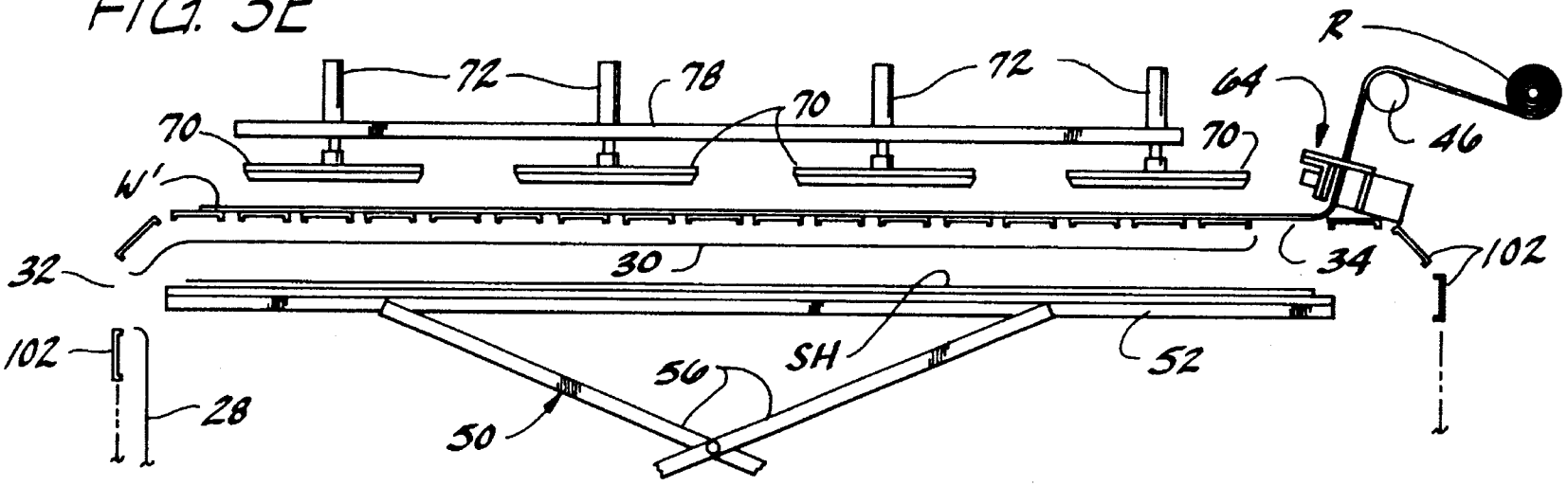
Figure 4:
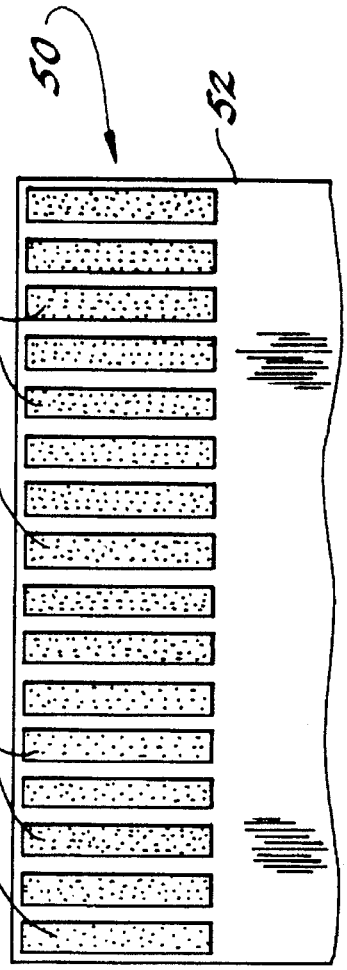
FIG. 4 is a fragmentary top plan of the rear end of a table of the apparatus for holding the spread.

The controller 172 reactivates the electric motor 38 so that the leading flight 28 in the upper reach 24 of the conveyor 22 resumes is forward motion and a new web W' of material is fed from the roll R (FIG. 3*b*). The wiper pads 70 and strips 66 of high friction material on the table 50 hold the first sheet SH lying on the leading flight 28 from movement in the forward direction F with the leading flight so that the leading flight slides out from under the first sheet and the sheet falls through the trailing opening 32 onto the table platform 52. The rearward wiper pad 70 is almost immediately moved to its raised position after reactivation of the motor 38 to permit the new web W' being fed from the roll R onto the upper reach 24 to pass under the rearward wiper pad 70 without hinderance by the wiper pad. Thus, as may be seen by reference to FIGS. 3*b*, 3*c*, 3*d* and 3*e*, the controller 172 sequentially activates the cylinders 72 beginning with the pair of cylinders nearest the rear end of the upper reach 24, and progressively activates the next rearwardmost pair of cylinders to move the wiper pads 70 to their raised positions. In this way, the next web W' from the roll may be fed onto the trailing flight 30 in the upper reach 24 of the conveyor at the same time the first sheet SH is wiped off of the leading flight 28 and onto the table 50.

The operation of the apparatus is then repeated to separate a second sheet (not shown) of material from the roll and deposit it on top of the first sheet SH lying on the platform 52 under the upper reach 24 of the conveyor 22. Further repetition of the operation of the apparatus will produce a stack of sheets of material on the platform. The height of the table (250, 350) in the second and third embodiments will be adjusted automatically to maintain the top of the stack of material so formed in close proximity to the underside of the conveyor (222, 322). When the stack reaches a predetermined height, the spread S is fully formed and is removed through an opening in the conveyor 22 and the open front end of the apparatus.

Typically, the sheets of material are laid onto craft paper (not shown) on the table 50 which protects the fabric and facilitates handling of the spread. As stated above, the apparatus of the third embodiment includes a cradle 343 for holding craft paper to be dispensed to the table for this purpose. A cutting machine (not shown) would ordinarily be located adjacent the forward end of the apparatus. Once the spread S is formed to a predetermined height by stacking one sheet of material on top of another according to the operation just described, the cutting machine (e.g., a Gerber 2001 cutting machine, manufactured by Gerber Garment Technology, Inc. of Tolland, Conn.) of conventional design would pull the spread off the table and onto the cutting machine for cutting the desired workpieces out of the material in the spread. It is believed that the apparatus of the present invention is capable of forming a spread S at least as quickly as the cutting machine is capable of cutting workpieces from the spread so that the formation of the spread will no longer be a bottleneck in the manufacture of articles such as clothing formed from the material in the roll.

In view of the above, it will be seen that the several objects of the invention are achieved and other advantageous results attained.

As various changes could be made in the above method without departing from the scope of the invention, it is intended that all matter contained in the above description and shown in the accompanying drawings shall be interpreted as illustrative and not in a limiting sense.

What is claimed is:

1. A method for forming a spread of generally thin, pliable material from a roll thereof onto a table, the spread comprising a stack of sheets of material cut from said roll of material, the method comprising the steps of:

(a) moving an endless conveyor having an upper reach disposed generally over the table so that the upper reach travels in a forward direction, the conveyor including a series of flights spaced at intervals therealong with openings between the flights;

(b) rotating the roll of material to feed a web of the material from the roll in generally the forward direction to the upper reach;

(c) carrying the web fed from the roll forwardly on a flight in the upper reach of the endless conveyor;

(d) stopping rotation of the roll of material and forward travel of the upper reach of the endless conveyor when a predetermined length of the web of material has been fed onto the flight;

(e) cutting the web of material to separate it from the roll of material, thereby forming a first sheet of material supported on the flight in the upper reach of the endless conveyor;

(f) restarting rotation of the roll of material to feed another web of material from the roll generally in the forward direction to the upper reach;

(g) restarting movement of the upper reach of the endless conveyor in the forward direction;

(h) holding the first sheet of material on the flight in the upper reach of the endless conveyor from moving forwardly with the flight whereby the flight slides from underneath the first sheet and the first sheet falls through an opening trailing the flight and onto the table at the same time said other web of material is fed onto a trailing flight in the upper reach of the endless conveyor and is carried in the forward direction by the trailing flight; and (i) repeating steps (d)–(h) for said other web of material and subsequent webs of material fed from the roll thereby to successively cut sheets of material from said roll of material and stack them one on top of another on the table to a predetermined height to form the spread.

2. A method as set forth in claim 1 wherein the roll of material is permanently located generally adjacent one end of the table and does not move across the table to form the spread.

3. A method as set forth in claim 2 wherein the step of cutting the web of material to separate it from the roll of material comprises the steps of:

clamping the web generally adjacent to the roll thereby to hold a transverse region of the web taut against a blade of a reciprocating knife;

activating the knife to reciprocate the blade generally along a line extending transverse to a lengthwise extension of the web thereby to cut through the material in said transverse region and separate the first sheet of material from the roll; and releasing the material from the clamp such that a trailing edge margin of the first sheet of material falls through the opening trailing the flight supporting the first sheet and into engagement with the table.

4. A method as set forth in claim 3 wherein the step of holding the first sheet of material on the endless conveyor from moving forwardly with the upper reach of the conveyor comprises the step of restraining said trailing edge margin of the first sheet from moving forwardly relative to the table.

5. A method as set forth in claim 4 wherein the step of restraining said trailing edge margin of the first sheet comprises the step of providing frictionalizing material on the table at a location generally at a rear end thereof, said trailing edge margin engaging the frictionalizing material.

6. A method as set forth in claim 4 wherein the step of restraining said trailing edge margin of the first sheet comprises the step of clamping at least a portion of said trailing edge margin against the table.

7. A method as set forth in claim 2 wherein the step of holding the first sheet of material on the endless conveyor from moving forwardly with the upper reach of the conveyor comprises the step of activating gripper means to engage an upwardly facing surface of the first sheet of material on the flight, and wherein the method further comprises the step of sequentially disengaging said gripper means from the upper surface of the first sheet starting adjacent to a trailing edge margin of the first sheet and proceeding toward a leading edge margin of the first sheet.

8. A method as set forth in claim 7 wherein said gripper means comprises a plurality of wiper members mounted on cylinders located generally above the upper reach of the endless conveyor and spaced apart for selectively moving the wiper members between an extended position and a retracted position, the step of sequentially disengaging said gripper means comprising the step of sequentially activating the cylinders beginning with a cylinder nearest a rear end of the upper reach to retract said wiper members.

9. A method as set forth in claim 2 wherein the step of holding the first sheet of material on the endless conveyor from moving forwardly with the upper reach of the conveyor comprises the step of clamping at least a portion of a trailing edge margin of the first sheet against the table.

10. Apparatus for forming a spread constituting a stack of sheets of thin, pliable material cut from a roll of material, the apparatus comprising:

means for holding the roll of material, said holding means being selectively operable to rotate the roll of material for feeding a web of the material generally forwardly from the roll;

an endless conveyor having upper and lower reaches, the conveyor having a series of flights spaced at intervals therealong with openings between the flights;

means for driving the conveyor for forward travel of its upper reach, the web from the roll of the material being received on and carried forward by a flight in the upper reach of the conveyor;

means for cutting the web to separate a first sheet of material from the roll of material, a trailing edge margin of the first sheet falling through an opening trailing the flight carrying the first sheet;

means under the upper reach and between the upper and lower reaches of the conveyor for holding the spread of material, said spread holding means being located in a fixed position relative to said roll holding means as the web of material is fed onto the conveyor;

gripper means selectively operable for gripping the first sheet of material and holding the first sheet of material from forward movement with the flight whereby the flight is adapted to slide out from under the first sheet of material with the first sheet falling onto said holding means.

11. Apparatus as set forth in claim 10 wherein said means for driving the conveyor is operatively connected to said roll holding means for simultaneously driving the conveyor and actuating said roll holding means to feed the web of material from the roll of material.

12. Apparatus as set forth in claim 10 wherein said cutting means comprises a blade extending generally transversely of the upper reach, and means for reciprocating the blade transversely of a lengthwise extension of the upper reach thereby to cut the first sheet of material away from the roll of material.

13. Apparatus as set forth in claim 12 further comprising means for mounting the blade for reciprocating motion transversely of the upper reach of the conveyor, said mounting means comprising a frame, blade guide means defining a channel in which the blade is received and blade support means engaging the blade in the channel for supporting the blade, said support means being constructed to provide substantially no resistance to the reciprocating motion of the blade.

14. Apparatus as set forth in claim 13 wherein said support means comprises a plurality of rollers mounted on the frame and projecting into the channel defined by said blade guide means and being engageable with the blade in the channel.

15. Apparatus as set forth in claim 13 further comprising means for clamping the web of material against the blade to facilitate cutting the first sheet away from the roll of material, said clamping means comprising a clamp platen and cylinders mounting the clamp platen on the frame at a location generally opposite the blade for selective movement of the clamp platen between a release position in which the clamp platen is spaced from the blade and the web of material is free to move from the roll of material through a space between the blade and clamp platen to the upper reach of the conveyor, and a clamp position in which the clamp platen engages the web and forces it against the blade.

16. Apparatus as set forth in claim 15 wherein the clamp platen extends longitudinally generally parallel to a lengthwise extension of the blade, and wherein the clamp platen has a longitudinal clearance groove therein for receiving the blade in said clamp position thereby providing clearance between the clamp platen and the blade.

17. Apparatus as set forth in claim 15 further comprising retractable blade guard means located alongside a sharpened end of the blade for protecting the web from inadvertent engagement with the blade in the release position of said clamp platen, said blade guard means being retracted upon movement of the clamp platen to said clamp position thereby to expose the sharpened end of the blade for cutting the web.

18. Apparatus as set forth in claim 17 wherein said retractable blade guard means comprises a pair of inverted L-shaped bars, a first leg of each bar being mounted on a respective side of said blade guide means for sliding motion relative to said blade guide means and a second leg of each bar extending outwardly from the first leg, and means for biasing the bar in an extended position in which the second leg is disposed outwardly of the sharpened end of the blade for engagement with the web to protect the web from engagement with the blade, the clamp platen being adapted to clamp the web of material against the second legs of the bars in the clamp position and to move the bars to their retracted position for exposing the sharpened end of the blade to cut the web.

19. Apparatus as set forth in claim 10 wherein said gripper means comprises a plurality of wiper members disposed generally above the upper reach of the conveyor at locations spaced longitudinally of the upper reach and adapted for movement between a raised position in which the wiper members are spaced above the upper reach of the conveyor to permit the web of material and upper reach to move forward conjointly under the wiper members, and a lowered position in which the wiper members engage an upper surface of the first sheet lying on the upper reach of the conveyor and hold the first sheet from movement with the flight supporting the first sheet thereby to wipe the web off of the flight through the opening trailing the flight and onto said spread holding means.

20. Apparatus as set forth in claim 19 further comprising means for controlling the wiper members to sequentially move from their lowered position to their raised position beginning with a wiper member closest to a rear end of the upper reach and progressing forwardly thereby to provide clearance for another web of material from the roll of material by said roll holding means to be fed onto the upper reach of the conveyor as the first sheet of material is wiped off the supporting flight and onto said spread holding means.

21. Apparatus as set forth in claim 10 wherein said roll holding means comprises a cradle which receives the roll of material, the cradle having a moving floor constructed to hold the roll from substantial translational movement and to rotate the roll about a longitudinal axis for feeding the web of material therefrom, and wherein said driving means is operatively connected to the conveyor and the moving floor for simultaneous operation of the conveyor and the moving floor of the cradle.

22. Apparatus as set forth in claim 10 wherein said spread holding means comprises a table mounted on a frame of the apparatus for motion relative to the frame in a vertical direction, and sensing means for sensing the location of a top of the stack of sheets, the table being adapted for movement in response to said sensing means to generally maintain the top of the stack at a predetermined distance from the conveyor.

23. Apparatus as set forth in claim 10 wherein said spread holding means comprises a table constructed to facilitate removal of the spread held on the table, the table comprising a hollow platform defining a plenum in communication with a source of pressurized air, and the platform having a plurality of holes in an upper surface thereof through which pressurized air in the plenum escapes to float the spread on the upper surface, the table further comprising at least one endless belt extending longitudinally over the upper surface of the platform under the spread, the belt being adapted to move under the spread for conveying the spread off of the platform.

24. Apparatus as set forth in claim 10 further comprising a catcher mechanism for capturing a trailing end portion of the first sheet of material separated from the roll.

* * * * *